US011795645B2

(12) United States Patent
Abeles

(10) Patent No.: US 11,795,645 B2
(45) **Date of Patent: *Oct. 24, 2023**

(54) PORTABLE WATER INFLATABLE BARRIER INTEGRAL WITH SUPPORT BASE

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/713,754

(22) Filed: Apr. 5, 2022

(65) Prior Publication Data

US 2022/0228337 A1 Jul. 21, 2022

Related U.S. Application Data

(63) Continuation-in-part of application No. 17/008,980, filed on Sep. 1, 2020, now Pat. No. 11,319,685, which (Continued)

(51) Int. Cl.

| | |
|---|---|
| ***E02B 3/10*** | (2006.01) |
| ***E02B 7/00*** | (2006.01) |
| ***E02B 3/12*** | (2006.01) |

(52) U.S. Cl.

CPC ..... *E02B 3/108* (2013.01); *E02B 3/127* (2013.01); *E02B 7/005* (2013.01)

(58) Field of Classification Search

CPC ..... E02B 3/106; E02B 3/108; E02B 3/127; E02B 7/005

(Continued)

(56) References Cited

U.S. PATENT DOCUMENTS

| | | | |
|---|---|---|---|
| 3,213,628 | A | 10/1965 | Serota |
| 3,355,851 | A | 12/1967 | Imbertson |

(Continued)

FOREIGN PATENT DOCUMENTS

| | | | | |
|---|---|---|---|---|
| CN | 114481950 | A * | 5/2022 | ..... E02B 3/108 |
| DE | 10119011 | C1 | 2/2003 | |

(Continued)

OTHER PUBLICATIONS

"Aqua-Barrier Water Inflated Dam," Web page <http://www.hydroresponse.com/aqua_barrier.htm>, 2 pages, Feb. 21, 2011, retrieved from Internet Archive Wayback Machine <https://web.archive.org/web/20110221031836/http://www.hydroresponse.com:80/aqua_barrier.htm> on Jun. 9, 2022.

(Continued)

*Primary Examiner* — Frederick L Lagman
(74) *Attorney, Agent, or Firm* — Maine Cernota & Curran

(57) ABSTRACT

A portable, water-filled barrier system includes a water-fillable module that is internally divided into cells that emulate a section of a sandbag dike or wall, the module being fixed to an underlying base having front and rear boundaries that extend up from base and horizontally restrain the module. The base can be flexible and water filled, or rigid, and can be installed at or below grade. A lid can extend between the front and rear boundaries of a rigid base to cover the unfilled module, enabling the assemblies to be stacked when stored and transported. The lid can be hinged and, when open, can be supported by at least one brace extending from behind the lid to underlying terrain, where it can be wedged or staked in place. Adjacent bases can be joined at the front and rear to maintain contact between adjacent modules.

20 Claims, 17 Drawing Sheets

Related U.S. Application Data is a continuation-in-part of application No. 16/525,872, filed on Jul. 30, 2019, now Pat. No. 10,767,329, which is a continuation-in-part of application No. 16/016,874, filed on Jun. 25, 2018, now Pat. No. 10,400,408, which is a continuation-in-part of application No. 15/630,457, filed on Jun. 22, 2017, now Pat. No. 10,036,134, which is a continuation-in-part of application No. 15/382,965, filed on Dec. 19, 2016, now Pat. No. 9,719,225, which is a continuation-in-part of application No. 15/016,606, filed on Feb. 5, 2016, now Pat. No. 9,556,574, which is a continuation of application No. 14/594,407, filed on Jan. 12, 2015, now Pat. No. 9,334,616, which is a continuation-in-part of application No. 13/663,756, filed on Oct. 30, 2012, now Pat. No. 8,956,077.

(60) Provisional application No. 61/553,403, filed on Oct. 31, 2011.

(58) Field of Classification Search
USPC ..... 405/111, 115
See application file for complete search history.

(56) References Cited

U.S. PATENT DOCUMENTS

| | | | | |
|---|---|---|---|---|
| 3,975,915 | A | 8/1976 | Haw | |
| 4,103,496 | A | 8/1978 | Colamussi | |
| 4,458,456 | A * | 7/1984 | Battle | E04H 9/145 52/63 |
| 4,692,060 | A | 9/1987 | Jackson, III | |
| 4,780,024 | A | 10/1988 | Obermeyer | |
| 4,784,520 | A | 11/1988 | Stevens | |
| 5,011,327 | A | 4/1991 | Thiac | |
| 5,059,065 | A | 10/1991 | Doolaege | |
| 5,125,767 | A | 6/1992 | Doolaege | |
| 5,176,468 | A | 1/1993 | Poole | |
| 5,857,806 | A | 1/1999 | Melin | |
| 5,865,564 | A | 2/1999 | Miller | |
| 5,971,661 | A | 10/1999 | Johnson | |
| 5,988,946 | A * | 11/1999 | Reed | E02B 3/102 405/91 |
| 5,993,113 | A | 11/1999 | Darling | |
| 6,022,172 | A | 2/2000 | Siyaj | |
| 6,216,399 | B1 * | 4/2001 | Belarbi | E02B 3/104 405/114 |
| 6,296,420 | B1 * | 10/2001 | Garbiso | E02B 3/108 383/69 |
| 6,334,736 | B1 | 1/2002 | Johnson | |
| 6,481,928 | B1 | 11/2002 | Doolaege | |
| 6,551,025 | B2 | 4/2003 | Dery | |
| 6,641,329 | B1 | 11/2003 | Clement | |
| 7,214,005 | B1 | 5/2007 | Davis | |
| 7,357,598 | B1 | 4/2008 | Bradley | |
| 8,500,365 | B1 * | 8/2013 | Vecherin | E04H 9/145 405/110 |
| 8,956,077 | B2 | 2/2015 | Abeles | |
| 9,334,616 | B2 | 5/2016 | Abeles | |
| 9,556,574 | B2 | 1/2017 | Abeles | |
| 9,719,225 | B2 | 8/2017 | Abeles | |
| 9,982,406 | B2 | 5/2018 | Bradley | |
| 10,036,134 | B2 | 7/2018 | Abeles | |
| 10,400,408 | B2 | 9/2019 | Abeles | |
| 10,767,329 | B2 | 9/2020 | Abeles | |
| 11,319,685 | B2 * | 5/2022 | Abeles | E02B 3/108 |
| 2004/0047688 | A1 | 3/2004 | Clement | |
| 2005/0260038 | A1 | 11/2005 | Sousa Costa | |
| 2006/0099033 | A1 | 5/2006 | Boraggina | |
| 2006/0275084 | A1 | 12/2006 | Harbeck | |
| 2007/0140598 | A1 | 6/2007 | McGillick, Sr. | |
| 2007/0154264 | A1 | 7/2007 | Baruh | |
| 2007/0237586 | A1 | 10/2007 | Prestininzi | |
| 2007/0243021 | A1 | 10/2007 | Tyler | |
| 2009/0064598 | A1 | 3/2009 | Mouyiaris | |
| 2009/0274519 | A1 | 11/2009 | Shaw | |
| 2010/0215436 | A1 | 8/2010 | Johnson | |
| 2010/0284747 | A1 | 11/2010 | Peterson | |
| 2012/0230766 | A1 | 9/2012 | Schnaars, Sr. | |
| 2012/0230768 | A1 | 9/2012 | Rowland | |
| 2013/0094905 | A1 | 4/2013 | Schnaars, Sr. | |
| 2014/0010601 | A1 | 1/2014 | Bradley, Sr. | |
| 2015/0240435 | A1 | 8/2015 | Schneider | |
| 2016/0083918 | A1 * | 3/2016 | Cadogan | E06B 9/0692 405/115 |
| 2016/0122962 | A1 * | 5/2016 | Mcnally | E02B 7/005 405/115 |
| 2016/0319504 | A1 | 11/2016 | Vickers | |
| 2019/0382974 | A1 | 12/2019 | Abeles | |
| 2020/0208366 | A1 * | 7/2020 | Chapron | E02B 3/06 |

FOREIGN PATENT DOCUMENTS

| | | | |
|---|---|---|---|
| DE | 20309206 | U1 | 9/2003 |
| DE | 102007010579 | A1 | 8/2008 |
| DE | 102007010579 | B4 | 8/2008 |
| EP | 1260635 | A2 | 11/2002 |
| FR | 2565271 | A1 | 12/1985 |
| FR | 2860251 | A1 | 4/2005 |
| GB | 2088935 | A | 6/1982 |
| GB | 2269618 | A | 2/1994 |
| GB | 2451286 | A | 1/2009 |
| GB | 2458941 | A | 10/2009 |
| KR | 820002208 | B1 | 11/1982 |
| KR | 101324434 | B1 | 11/2013 |
| SK | 50792009 | U1 | 10/2010 |
| WO | 2009019681 | A1 | 2/2009 |
| WO | 2013167787 | A1 | 11/2013 |
| WO | 2016051002 | A1 | 4/2016 |

OTHER PUBLICATIONS

"Aqua Dam Water Controlling Water," Web page <http://www.aquadam.com/index.htm>, 1 page, Oct. 9, 2011, retrieved from Internet Archive Wayback Machine <https://web.archive.org/web/20111009020959/www.aquadam.com/index.htm> on Jun. 9, 2022.

Biggar; K et al. "Alternatives to Sandbags for Temporary Flood Protection." Alberta Transportation and Utilities Disaster Services Branch and Emergency Preparedness Canada (Oct. 1998), 78 pages.

"HydraBarrier Sandbag Alternative," Web page <http://www.hydrabarrier.com/index.htm>, 2 pages, Oct. 6, 2011, retrieved from Internet Archive Wayback Machine <https://web.archive.org/web/20111006101116/http://www.hydrabarrier.com/index.htm> on Jun. 9, 2022.

"IFDP Temporary Barriers," Web page <http://www.ifdp.co.uk/products/temporaryBarriers.html>, Sep. 3, 2011, retrieved from Internet Archive Wayback Machine <https://web.archive.org/web/20110903034515/http://www.ifdp.co.uk/products/temporaryBarriers.html> on Jun. 9, 2022.

Office Action for U.S. Appl. No. 13/663,756 dated May 22, 2014, 8 pages.

Notice of Allowance for U.S. Appl. No. 13/663,756 dated Oct. 22, 2014, 5 pages.

Office Action for U.S. Appl. No. 14/594,407 dated Aug. 27, 2015, 10 pages.

Notice of Allowance for U.S. Appl. No. 14/594,407 dated Jan. 29, 2016, 5 pages.

Office Action for U.S. Appl. No. 15/016,606 dated Jul. 5, 2016, 9 pages.

Notice of Allowance for U.S. Appl. No. 15/016,606 dated Sep. 21, 2016, 7 pages.

Notice of Allowance for U.S. Appl. No. 15/382,965 dated Mar. 24, 2017, 15 pages.

Office Action for U.S. Appl. No. 15/630,457 dated Aug. 24, 2017, 11 pages.

Corrected Notice of Allowance for U.S. Appl. No. 15/630,457 dated Apr. 2, 2018.

(56) References Cited

OTHER PUBLICATIONS

Office Action for U.S. Appl. No. 16/016,874 dated Dec. 13, 2018, 9 pages.
Notice of Allowance for U.S. Appl. No. 16/016,874 dated Apr. 24, 2019, 5 pages.
Office Action for U.S. Appl. No. 16/525,872 dated Dec. 27, 2019, 9 pages.
Notice of Allowance for U.S. Appl. No. 16/525,872 dated May 8, 2020, 5 pages.
Office Action for U.S. Appl. No. 17/008,980 dated Aug. 12, 2021, 9 pages.
Notice of Allowance for U.S. Appl. No. 17/008,980 dated Jan. 12, 2022, 7 pages.

* cited by examiner

PORTABLE WATER INFLATABLE BARRIER INTEGRAL WITH SUPPORT BASE

RELATED APPLICATIONS

This application is a continuation in part of U.S. application Ser. No. 17/008,980, filed on Sep. 1, 2020, now U.S. Pat. No. 11,319,685. Application Ser. No. 17/008,980 is a continuation in part of application Ser. No. 16/525,872, filed on Jul. 30, 2019, now U.S. Pat. No. 10,767,329. Application Ser. No. 16/525,872 is a continuation in part of application Ser. No. 16/016,874, filed on Jun. 25, 2018, now U.S. Pat. No. 10,400,408. Application Ser. No. 16/016,874 is a continuation in part of application Ser. No. 15/630,457, filed on Jun. 22, 2017, now U.S. Pat. No. 10,036,134. Application Ser. No. 15/630,457 is a continuation in part of application Ser. No. 15/382,965, filed on Dec. 19, 2016, now U.S. Pat. No. 9,719,225. Application Ser. No. 15/382,965 is a continuation in part of application Ser. No. 15/016,606, filed on Feb. 5, 2016, now U.S. Pat. No. 9,556,574. Application Ser. No. 15/016,606 is a continuation of application Ser. No. 14/594,407, filed on Jan. 12, 2015, now U.S. Pat. No. 9,334,616. Application Ser. No. 14/594,407 is a continuation in part of application Ser. No. 13/663,756, filed on Oct. 30, 2012, now U.S. Pat. No. 8,956,077. Application Ser. No. 13/663,756 claims the benefit of U.S. Provisional Application No. 61/553,403, filed Oct. 31, 2011. All of these applications are herein incorporated by reference in their entirety for all purposes.

FIELD OF THE INVENTION

The invention relates to temporary barriers, such as dikes used for flood control, and more particularly, to water-filled portable barriers.

BACKGROUND OF THE INVENTION

Circumstances sometimes arise where a temporary dike, wall, or other barrier is needed to prevent a flood, landslide, or other threat from spreading and threatening lives and property. Often, such a temporary barrier is constructed from sandbags, whereby empty bags and a quantity of dirt or sand are brought to the site, and a crew of workers fills the bags with the dirt or sand and stacks the bags to form the barrier. With reference to FIG. 1, the bags are often stacked so as to form a barrier with a "pyramid" cross-section 100 that is widest at the base, and narrower at the top.

In some cases, the weight of the sand in the barrier 100 is sufficient to hold the barrier 100 in place during the flood or other threat. With reference to FIG. 2, in other cases a shallow trench 200 is prepared first, the trench having a depth that is approximately equal to the thickness of one sandbag. One or two rows of sandbags 202 are laid in the trench 200, with the remainder of the barrier 100 being constructed on top of the initial one or two rows 202. In this way, friction between the sandbags in the trench and the remainder of the sandbags further helps to hold the barrier in place.

A sandbag barrier is generally effective and the materials are relatively inexpensive. Furthermore, a sandbag barrier is easily adapted to extend between arbitrary locations, even if a curved, angled, or otherwise shaped barrier is required. However, there can be significant costs and construction time associated with a sandbag dike, due to the requirement to bring the sand or dirt to the construction site, which may weigh many tons, and due to the need to employ significant labor to fill and stack the bags.

In addition, after the flood or other threat has subsided, disposal of the sandbags can be time consuming and costly, especially if the sand and bags have become wet and contaminated by flood water and require special disposal procedures to avoid risks to health and to the environment.

What is needed, therefore, is a portable dike, wall, or other barrier that can withstand and contain the pressure of flood waters in a manner at least as effective as a sandbag dike or wall, but does not require delivery of large quantities of heavy materials to the construction site, does not require large amounts of labor to assemble, and is simple and inexpensive to remove when it is no longer needed.

SUMMARY OF THE INVENTION

A portable, modular, water-inflatable barrier system includes at least one barrier module that has an internal structure similar to a sandbag dike or wall, and functions in a similar manner, but does not require delivery of large quantities of heavy materials to the construction site, does not require large amounts of labor to assemble, and is simple and inexpensive to remove when no longer needed. The barrier comprises a plurality of interconnected, water-inflatable modules, each of which is made of a light, flexible material such as a heavy plastic or nanofiber. The modules can be transported to the construction site in a deflated state, after which they can be positioned, interconnected, and filled with locally available water. In embodiments, each module weighs less than 250 pounds, such that they can be lifted and carried without heavy machinery.

Each module of the barrier is a single unit that includes shaping and internal partitions which create an overall structure similar to a pile of sandbags in a sandbag wall. The interiors of the barrier modules are divided into pluralities of cells. Passages between the tops and bottoms of the cells in each module allow each of the modules to be filled from a single water inlet. Embodiments include a manifold that allows an entire assembly of modules to be simultaneously filled from a single water inlet.

In some embodiments, the cells in each module include passive automatic valves that seal the passages between the cells after the cells are filled with water, so that deflation of one cell in a module due to a puncture or some other cause will not cause the cells beneath it to deflate. In some embodiments, the outer shells of the barrier modules are made of a material that is thicker than the interior dividing walls, such as thick plastic, a synthetic rubber, or a thick layer of nanofiber, so as to better resist puncture by an external threat. In similar embodiments, the outer shells are double-walled, so that puncture of the outer wall does not affect the internal cells, so long as the inner wall remains intact. In certain embodiments the walls are coated with a protective material such as Tyvek or liquid rubber that will seal punctures if they occur.

In embodiments, the barrier modules can be initially inflated with air, so that they can be easily positioned and interconnected. The barrier modules can then be filled with water, while the displaced air is released through a pressure valve at the top of the barrier. In some of these embodiments, pre-inflation of the barrier modules with air allows interlocking barrier modules to be easily placed in their interlocking configuration before the air within the barrier modules is replaced by water.

The internal structures of the barrier modules enable them to maintain their shape when the barrier is subjected to externally applied horizontal forces, such as pressure from flood waters. In some embodiments, the shape of the structure is made even more rigid by the inclusion within the cells of stiff, lightweight rods or plates made of plastic, bamboo, or a similar material.

In addition to maintaining their shapes and resisting punctures while in use, barrier modules must also resist horizontal displacement due to horizontal pressure from flood waters and due to impacts by floating objects that are carried by the flood waters. It is notable that displacement of a module even by a small amount relative to its neighbors can lead to leakage of water between the modules.

By themselves, the barrier modules are resistant to horizontal displacement due to friction between their bases and the underlying ground surface, as well as due to friction between adjoining modules. This can be enhanced, for example by providing a high-friction surface on the bottoms of the modules, and/or by providing an underlying sheet that can be installed between the modules and the ground. In embodiments, the underlying sheet can be folded over the front of the barrier, thereby providing additional protection against strikes from floating objects.

In embodiments, barrier modules can be attached to each other, for example by straps that interconnect between loops provided on the sides of the modules. Such attachment can provide additional resistance to horizontal displacement of modules relative to each other. In further embodiments, additional cells extend below the bases of the inflatable barrier modules, so that they can be placed in a trench prepared at the construction site, thereby further resisting horizontal dislodgement of the barrier by flood waters or other forces. In some embodiments, the barrier modules have interlocking ends that provide structural cooperation and a water-tight seal between adjacent barrier modules.

In embodiments, the disclosed barrier is fixed to an underlying base that increases friction with the underlying ground and provides additional support to at least the front and rear of the barrier. In embodiments, the base is surrounded by a rim that forms a hollow within which the barrier resides.

In embodiments, the base is inflatable with water, and in some of these embodiments the base is in liquid communication with the barrier, such that the entire assembly of base and modular barrier can be simultaneously inflated with water.

In other embodiments, the base is substantially rigid. In some of these embodiments, a lid is provided that forms a chamber within which the deflated barrier can be contained when not in use. The chamber can have open or closed sides, depending on the design of the base. In various embodiments, this approach allows the entire assembly to be installed below grade at a site that is susceptible to flooding, such as a seashore or lake shore, with the top of the lid being at grade. When there is a present danger of a flood, it is then only necessary to remove the lid and fill the barrier with water. Being buried below grade and fixed to the barrier, the rigid base provides firm resistance to horizontal displacement of the barrier once it is deployed. Or, the entire assembly can be remotely stored, and then brought to the site when needed and deployed above grade. In embodiments, the lid enables the barrier modules with their bases to be stacked on top of each other during storage and transportation, for example by a flatbed truck.

In embodiments, the lid is attached by a hinge to the base, such that it can be easily rotated by at least 90 degrees to allow inflation of the base without requiring removal and storage of the lid. And in some of these embodiments, at least one brace is provided that extends from the opened lid to the ground behind the base, for example at an angle of approximately 45 degrees, where it can be wedged in place, staked, or otherwise fixed to the ground.

A first general aspect of the present invention is a water-inflatable barrier system that includes a first barrier module having first module flexible walls forming a first module shell configured to contain water within a first module interior of the first barrier module, said first module shell having a first module front, a first module rear, a substantially rectangular first module bottom, a first module length parallel to the first module front, a first module width perpendicular to the first module front, and a first module cross section that is wider at a first module bottom of the first barrier module than at a first module top of the first barrier module, a plurality of substantially horizontal and substantially vertical first module partition walls dividing said first module interior into a plurality of adjacent, water-tight first module cells shaped as rectangular parallelepipeds, front and rear first module partition walls of each first module cell being substantially parallel to the first module front of the first module shell, said first module cells being arranged in a plurality of vertically stacked layers that are offset from each other such that none of the first module front and rear partition walls aligns with a first module front or rear partition wall in a vertically adjacent layer, a first module water inlet in liquid communication with the first module interior, and a plurality of first module passages between the first module cells, said first module passages being configured to allow filling of all of the first module cells with water from the first module water inlet. The first barrier module is fixed to a first base that underlies the first barrier module and is locatable on underlying terrain, said first barrier module being configured, when filled with water, to rise above front and rear boundaries of the first base that extend upward in front of and behind the first barrier module.

In embodiments, the front and rear boundaries of the first base are included in a raised perimeter that surrounds the first barrier module.

In any of the above embodiments, the first base can be flexible and fillable with water. In some of these embodiments, the first base is in liquid communication with the first barrier module. In other embodiments the first base is substantially rigid. Some of these embodiments further include a first lid configured to extend between the front and rear boundaries of the first base, thereby covering the first barrier module when it is not filled with water. In some of these embodiments, the first lid is attached to the rear boundary of the first base by a hinge, thereby enabling the first lid to be rotated into an open configuration that allows the first barrier module to expand above the front and rear boundaries of the first base as it is filled with water. Some of these embodiments further include a brace configured to extend from behind the first lid to said underlying terrain. In some of these embodiments, the brace includes an anchor configured to fix a distal end of the brace to the underlying terrain, where the anchor can include a spike configured for insertion into the underlying terrain.

In any of the above embodiments, the barrier system can further include a second barrier module fixed to a second base, sides of said first and second barrier modules being configured for mutual contact. In some of these embodiments, the first and second bases are configured for mutual attachment to maintains the mutual contact between the sides of the first and second barrier modules.

A second general aspect of the present invention is a method of constructing a barrier assembly. The method includes providing a water inflatable barrier system according to claim 1, placing the barrier system at a desired location, and filling the first barrier module with water.

In some embodiments, the first base is flexible, fillable with water, and in liquid communication with the first barrier module, such that filling the first barrier module with water results in filling the first base with water.

In any of the above embodiments, placing the barrier system at the desired location can include installing the first base below grade at the desired location.

In any of the above embodiments, the barrier system can further comprise a second barrier module fixed to a second base, and placing the barrier system at the desired location can further comprise placing the second base adjacent to the first base, thereby bringing the first and second barrier modules into mutual contact with each other. In some of these embodiments where the second base is substantially rigid, the barrier system can further include a second lid configured to extend between front and rear boundaries of the second base, and wherein the method further includes placing the second lid onto the second base, the second barrier module not being filled with water, so that the second lid covers the second barrier module, and placing the first base on top of the second lid in a stacked configuration during at least one of storing the barrier system and transporting the barrier system to the desired location. In some of these embodiments the second lid is attached to the rear boundary of the second base by a hinge, and the method further includes rotating the first lid into an open configuration that allows the first barrier module to expand above the front and rear boundaries of the first base as it is filled with water, fixing a proximal end of a brace to the first lid, and fixing a distal end of the brace to the underlying terrain. And in some of these embodiments fixing the distal end of the brace to the underlying terrain includes inserting a stake into the underlying terrain.

Any of the above embodiments can further include inflating the first barrier module with air before placement of the barrier system at the desired location, and filling the first barrier module with water can include removing the air from the first barrier module.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
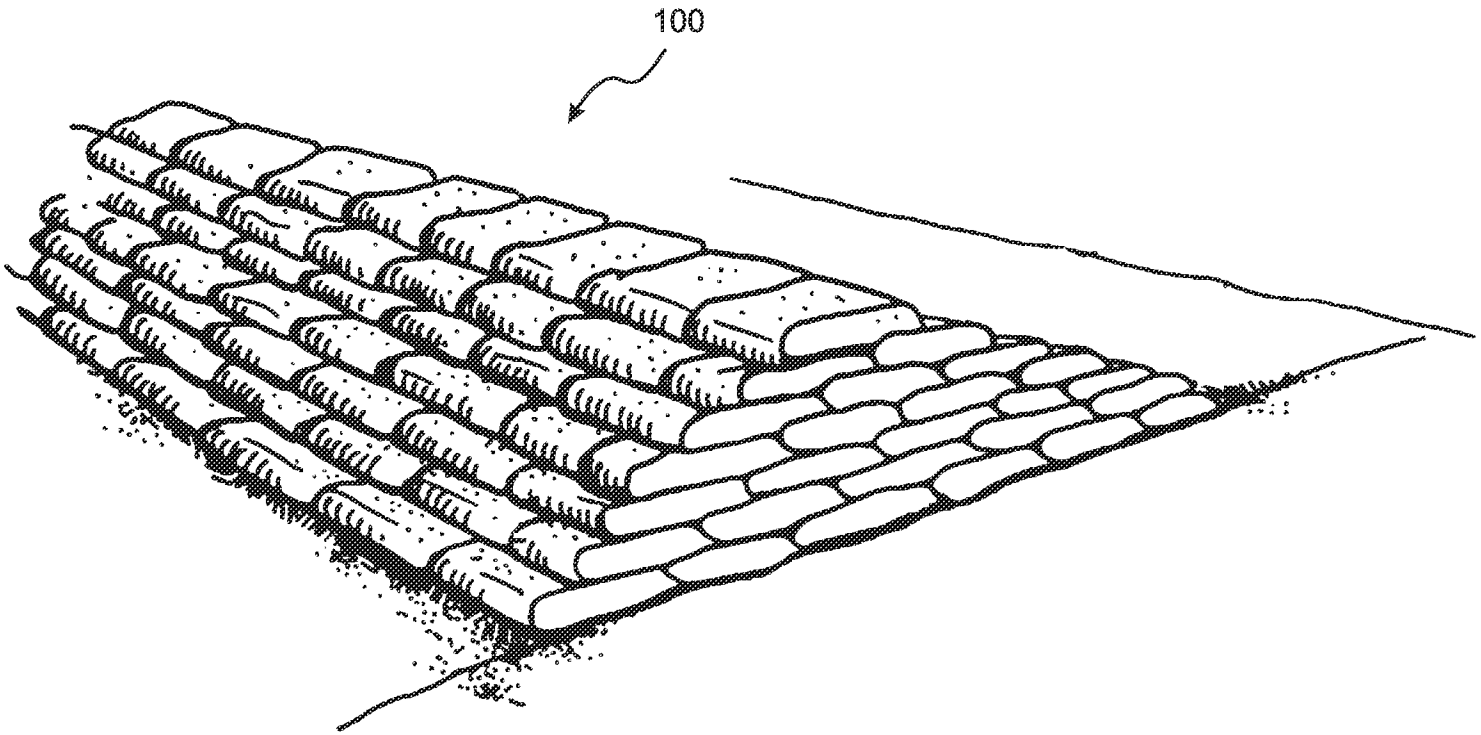
Fig. 1 Prior Art
FIG. 1 is perspective view of a sandbag barrier of the prior art having a flat base.
Figure 2:
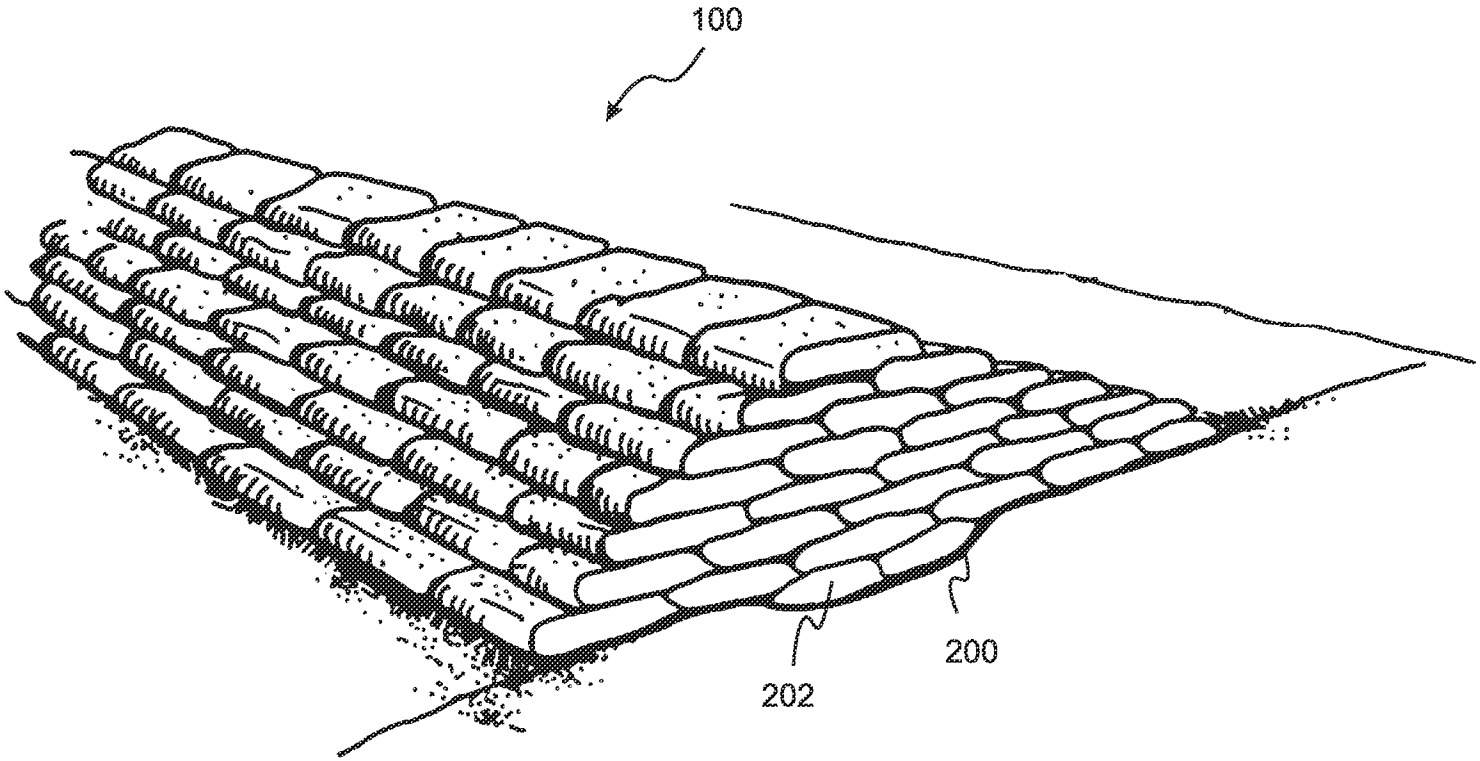
Fig. 2 Prior Art
FIG. 2 is perspective view of a sandbag barrier of the prior art having two rows of sandbags at its base that are placed in a trench prepared at the construction site.
Figure 3:
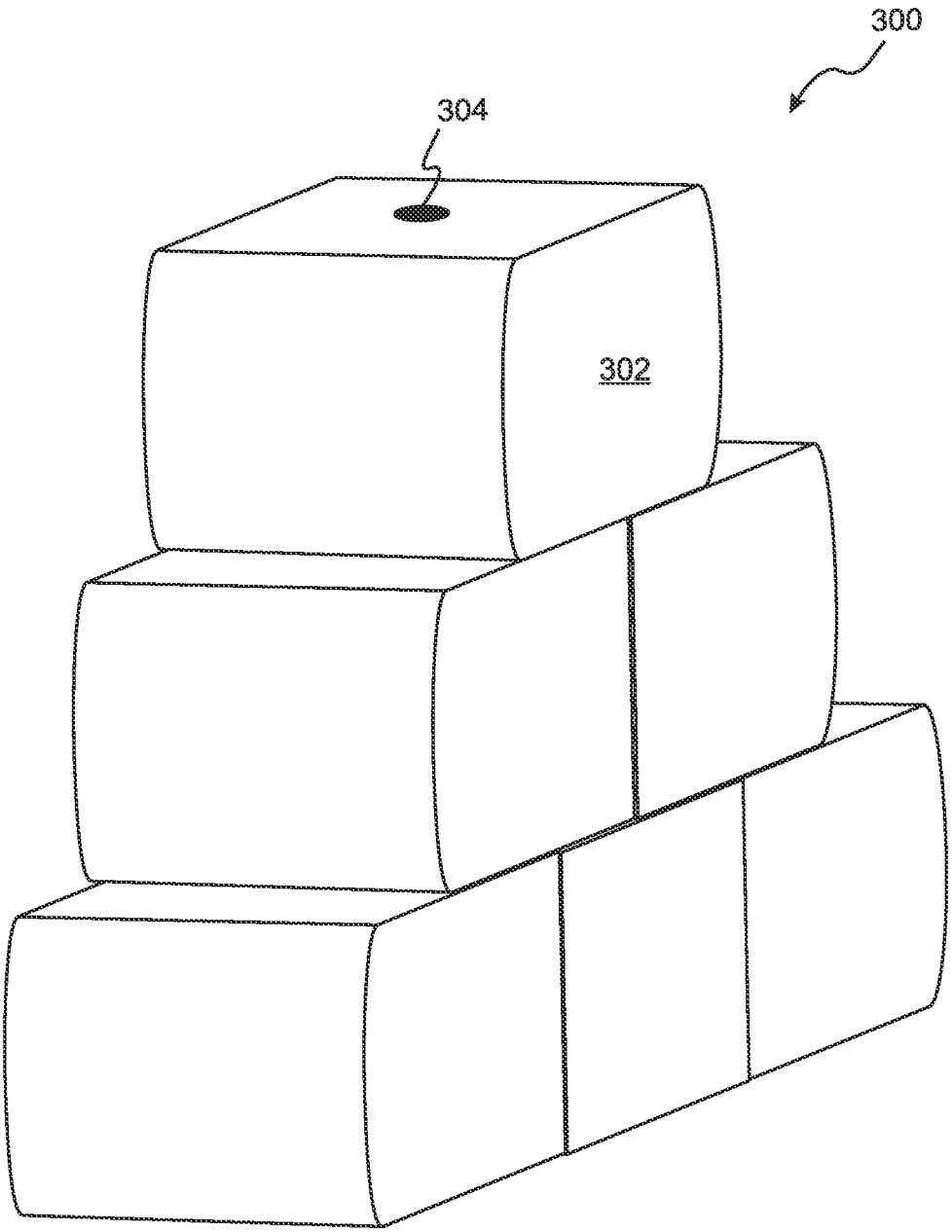
FIG. 3 is a perspective view of a single module that is one cell in length in an embodiment of the present invention.

The present invention is a portable, modular, water-inflatable barrier that has a structure similar to a sandbag dike or wall 100 and functions in a similar manner, but does not require delivery of large quantities of heavy materials to the construction site, does not require large amounts of labor to assemble, and is simple and inexpensive to remove when no longer needed. With reference to FIG. 3, the barrier comprises one or more barrier modules 300, each of which is made of a light, flexible material, such as a heavy plastic for nanofiber, and can be transported to the construction site in a deflated state, after which it is positioned and filled with locally available water. In embodiments, the modules 300 are coated with a material such as Tyvek or liquid rubber that will tend to seal any puncture of the material that may occur. In some embodiments, each module 300 weights less than 250 pounds, so that it can be lifted and carried without using heavy machinery.

Figure 4A:
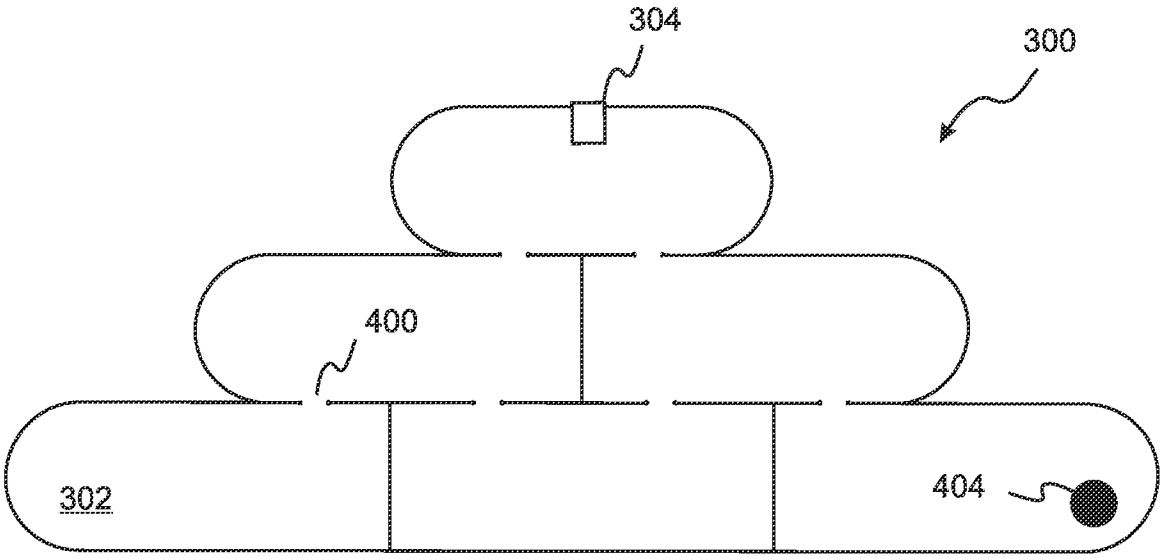
FIG. 4A is a cross sectional view of a module in an embodiment having a water inlet on top, a water outlet near the bottom, and simple passages between tops and bottoms of cells.

In the embodiment of FIG. 3, the interior of the module is divided into a plurality of approximately rectangular cells 302. A port 304 for filing and/or emptying the module 300 is provided in the top surface. With reference to FIG. 4A, passages 400 between the tops and bottoms of the cells 302 allow the entire barrier module 300 to be filled from a single water inlet 304. In the illustrated embodiment, a separate water outlet 404 is provided at the base of the structure 300.

Figure 4B:
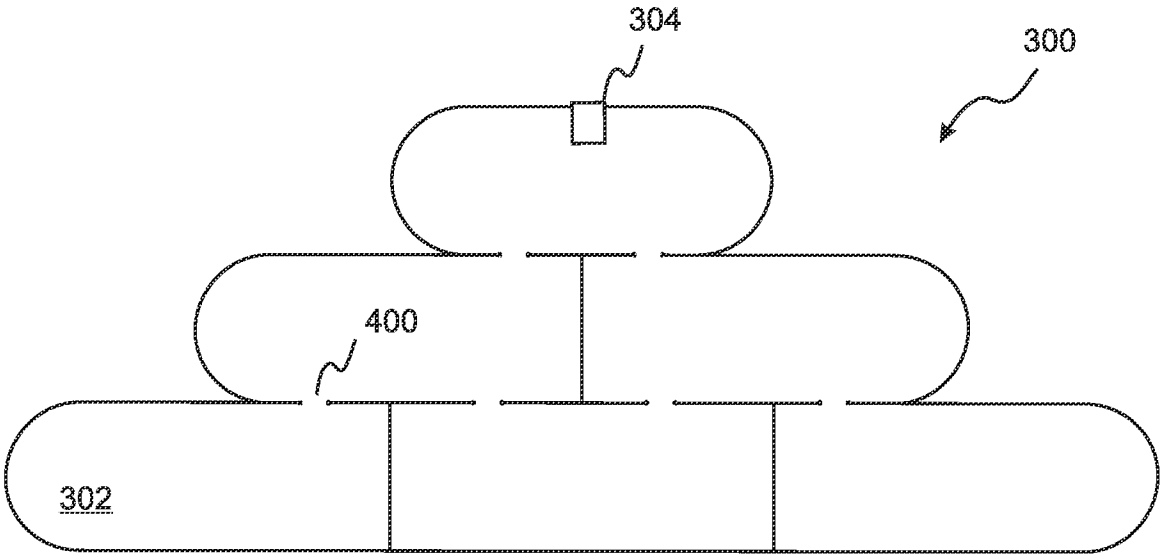
FIG. 4B is a cross sectional view of a module in an embodiment similar to FIG. 4A, but including only a water port at the top through which the barrier is both filled and emptied with water.

With reference to FIG. 4B, in some embodiments a separate water outlet 404 is not included, and instead water is both added and removed through a common port 304 at or near the top or bottom of the barrier module 300. This allows water to be removed from the barrier module 300 without introducing air, so that removing the water causes the barrier module to be collapsed in preparation for packing and transport.

In some embodiments, lateral passages (not shown) are provided at least between adjoining cells in the bottom rear row, so that a single outlet can drain all of the cells 302 in the barrier module 300.

Figure 5:
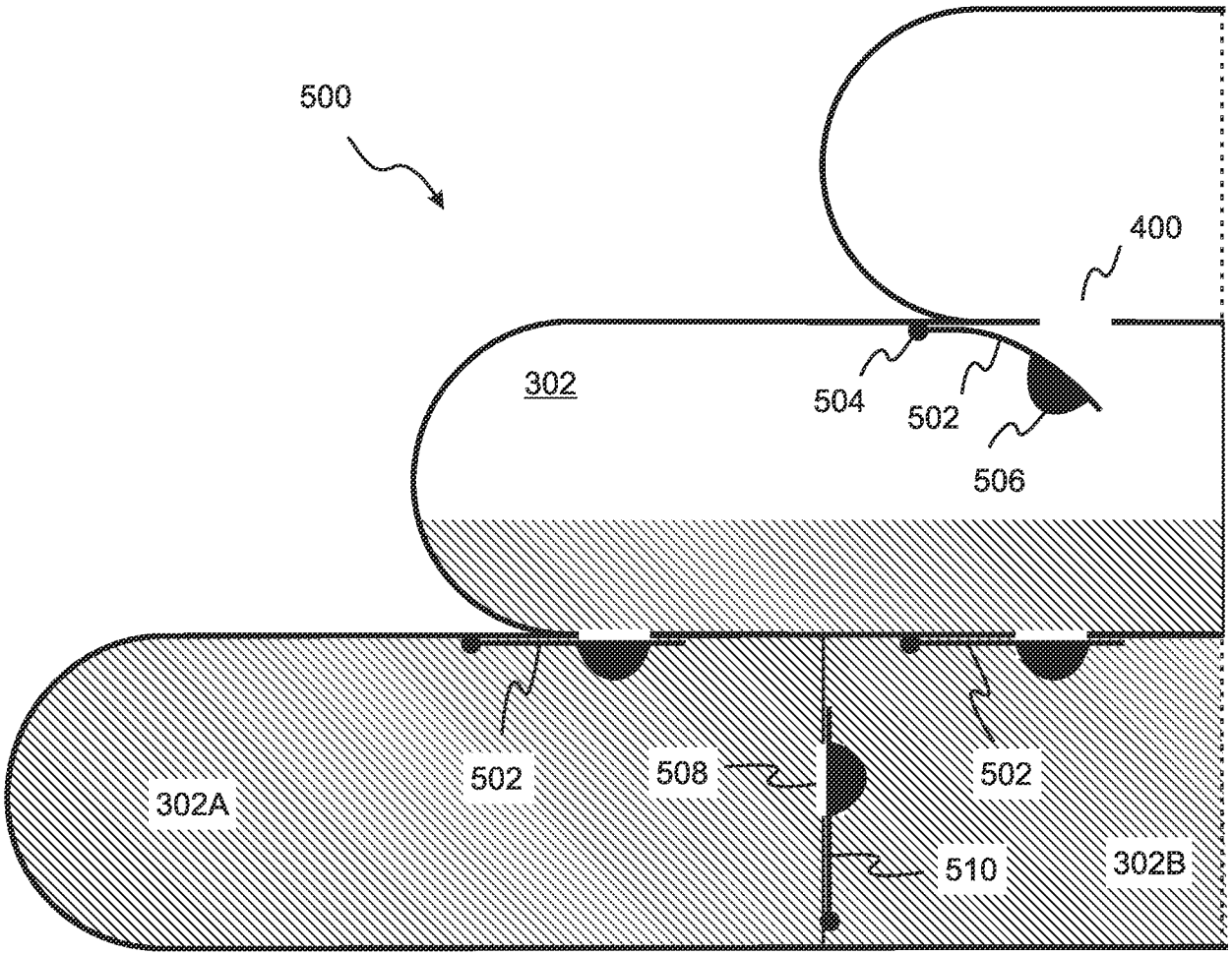
FIG. 5 is a partial cross-sectional view of a module in an embodiment having passages between tops and bottoms of cells that are closable by passive valves.

With reference to FIG. 5, in some embodiments 500 the cells 302 include passive automatic valves 500 that seal the passages 400 after the cells 302 are filled with water, so that deflation of one cell due to a puncture or some other cause will not cause the cells beneath it to deflate. In the embodiment 500 of FIG. 5, the valves 502 are flaps of elastic material joined to the upper surfaces of the cells 302 by living hinges 504. A small air bladder 506 is included in the region of the valve 502 that is positioned to cover the passage 400. When the cell 302 is empty, gravity causes the valve 502 to fall away from the passage 400, so that the cell 302 can fill with water. However, once the cell 302 is full of water, the air bladder 506 lifts the valve 502 into place and closes the passage 400. Once the valves 502 are closed, if a cell should develop a leak and deflate, only the cells directly above it will be affected.

In addition, the embodiment 500 of FIG. 5 includes lateral passages 508 between neighboring cells at the lowest level of the barrier, so that the entire barrier can be emptied through a single water outlet 404 located at the lower rear of the structure 500. These lateral passages 508 include automatic valves 510 that will allow water to flow toward the rear as the cells empty from back to front, but will prevent water flowing from rear to front if one of the front cells is damaged.

Typically, the cells in the front row 302, 302A will be the cells that are directly exposed to threats such as debris carried by flood waters. The front cells 302, 302A are therefore the ones most likely to be damaged or punctured. In the embodiment of FIG. 5, if a cell 302A in the bottom front row is punctured, the lateral valve 510 will prevent water from flowing out of the cell next to it 302B and into the damaged cell 302A. However, if the rear cells 302B are drained first during the normal drainage process, then the lateral valves 510 will open and water from the front cells 302A will flow out.

Figure 6:
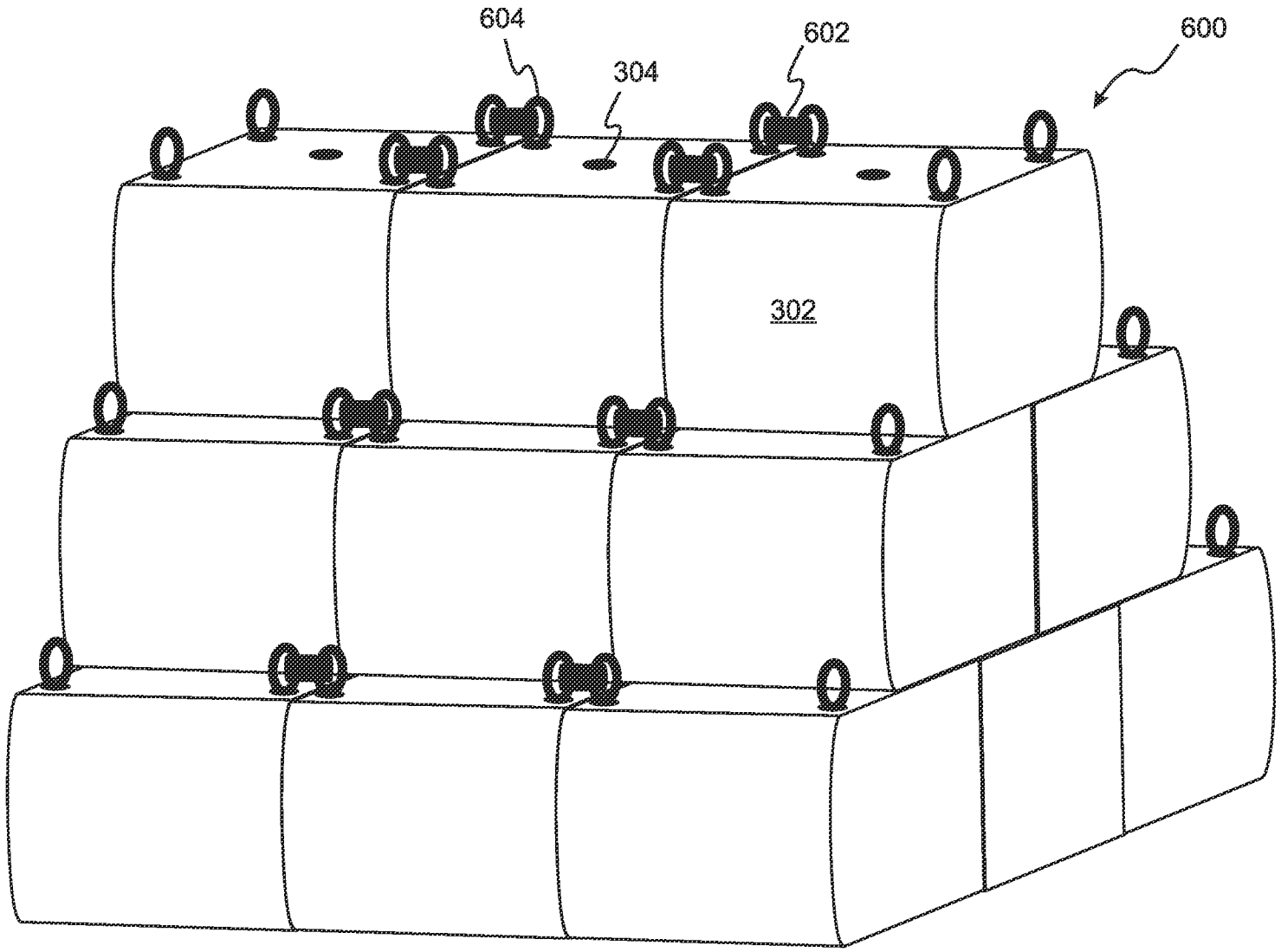
FIG. 6 is a perspective view showing three of the modules of FIG. 3 interconnected using loops and straps to form a partial barrier.

Embodiments of the present invention comprise a plurality of modules 300 that are arranged side-by-side and coupled to each other. FIG. 6 illustrates the interconnection of three of the modules 300 illustrated in FIG. 3 so as to form at least part of a barrier 600. In this embodiment, the coupling mechanism that interconnects the modules 300 comprises loops 604 that are attached to the upper surfaces of the cells, whereby adjacent loops of adjoining modules are attached by straps 602. In similar embodiments, the loops 604 are interconnected by clamps or other fastening means known in the art.

Figure 7:
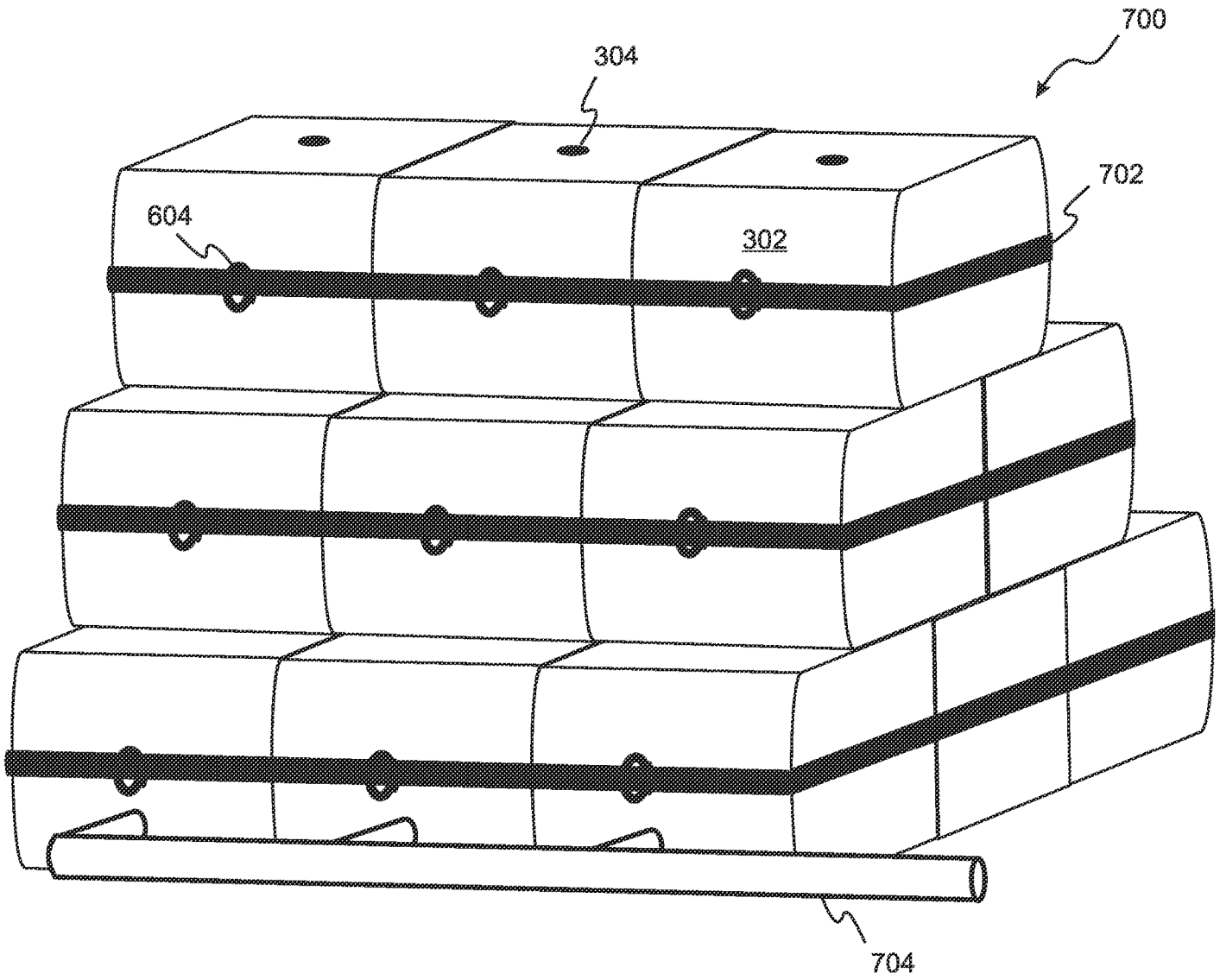
FIG. 7 is a perspective view of an embodiment similar to FIG. 6, but wherein a single strap extends through loops positioned on front faces of more than two of the modules.

FIG. 7 is a perspective rear view of an embodiment 700 similar to FIG. 6, except that the loops 604 are located on both the front-facing and rear-facing surfaces of the modules 300, and a single, continuous strap 702 is passed through the loops 604 and around the modules 300 so as to attach the modules 300 and form the barrier 700. The embodiment of FIG. 7 also includes a manifold 704 that can be used to fill all of the modules 300 simultaneously through fill-ports provided in the bases of the modules 300.

Figure 8:
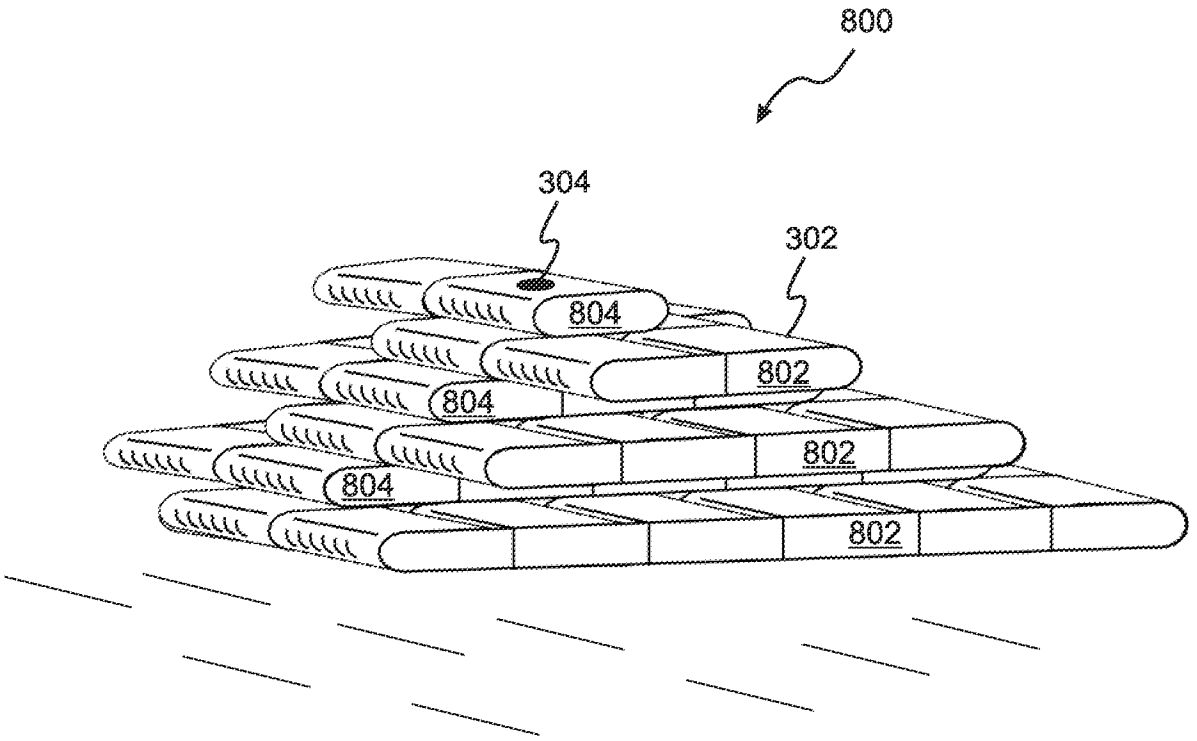
FIG. 8 is a perspective view of a module in an embodiment where the module has interlocking ends.

With reference to FIG. 8, in some embodiments the barrier modules 800 have interlocking ends that provide structural cooperation and a water-tight seal between adjacent modules. FIG. 8 is a perspective view of a single module 800 that is three cells wide. The module includes alternate rows of cells 802 that extend from the ends by a length of one cell, while the interleaved rows 804 do not. The opposite pattern is provided on the other end of the module 800. It can be seen that a second module of the same configuration can be positioned so that its extended cells fit between the extended cells 802 of the adjacent module 800. In some of these embodiments, as mentioned above, the modules 800 can be initially filled with air and positioned with the ends interlocking, after which the modules 800 are filled with water while the displaced air is allowed to escape through pressure valves 304 provided at the tops of the modules 800.

Figure 9A:
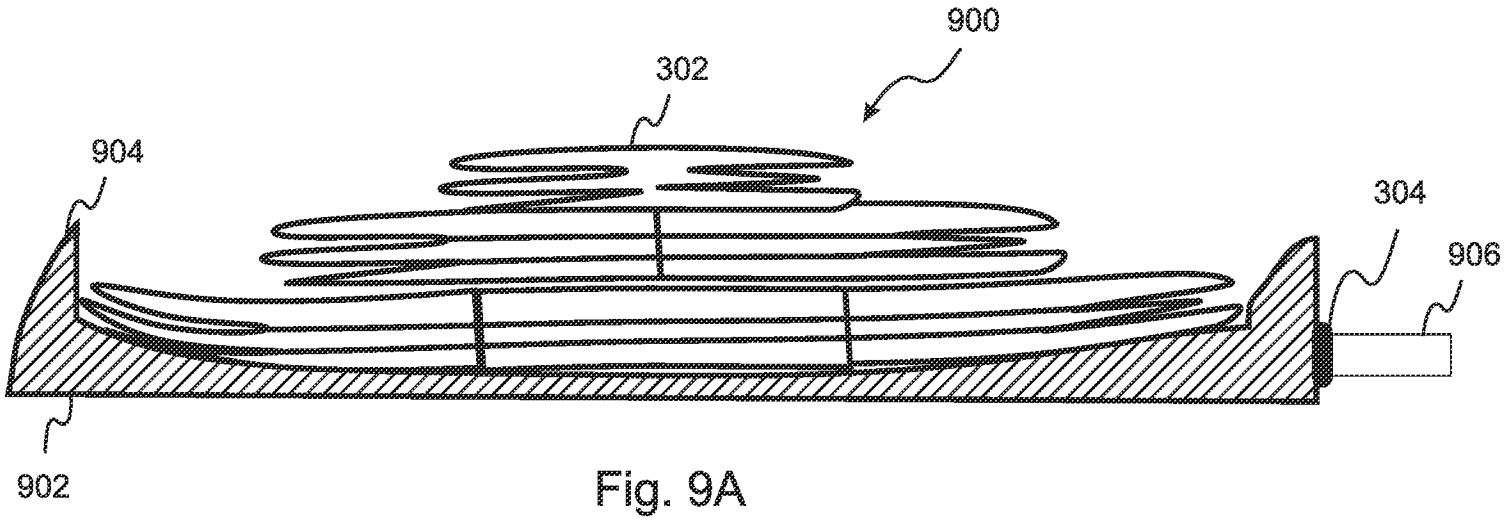
FIG. 9A is a side view of an embodiment of the present invention in which the barrier module is fixed to an underlying base, flexible base that can be filled with water, the barrier and base being shown before filling thereof with water.
Figure 9B:
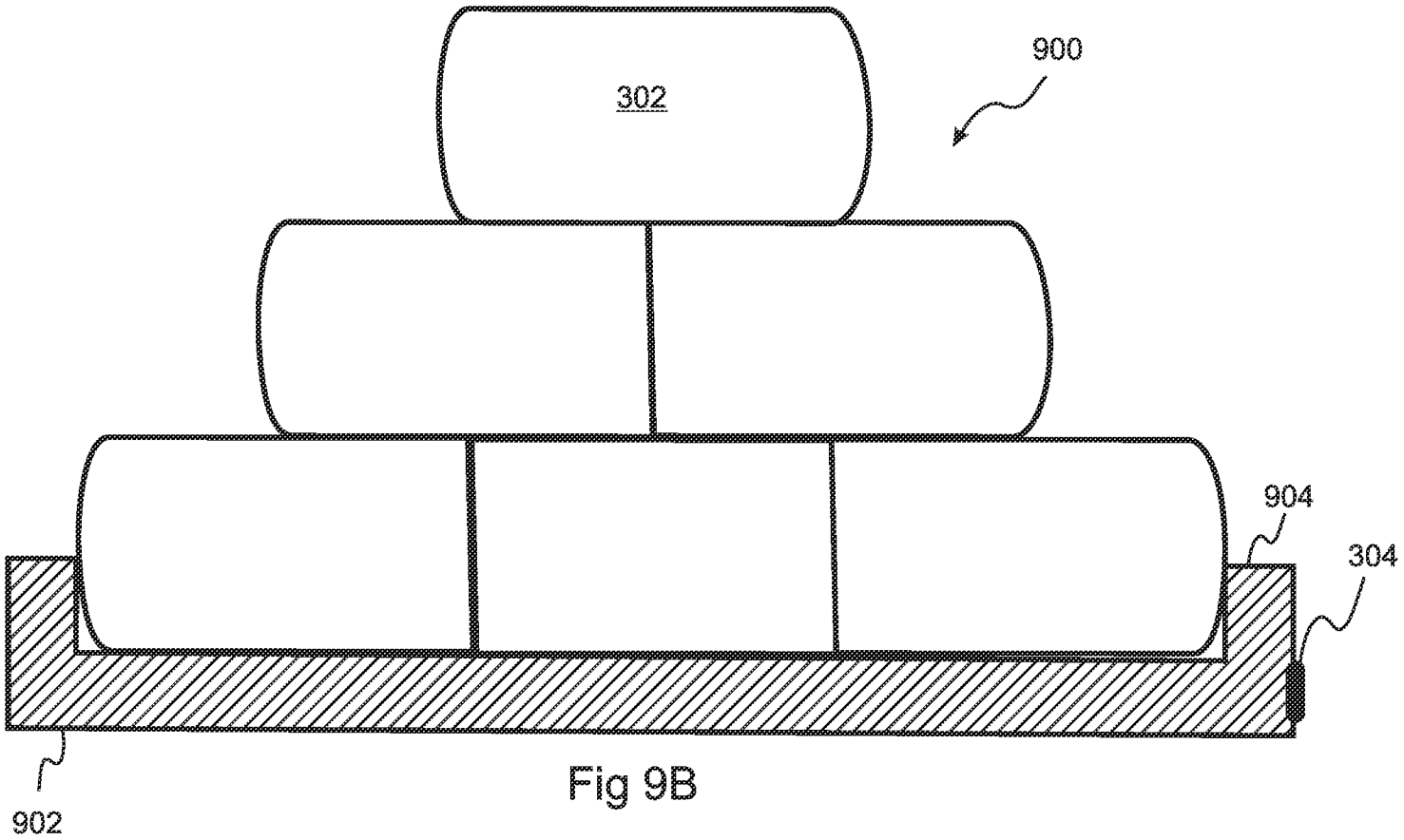
FIG. 9B is a side view of the embodiment of FIG. 9A shown after filling of the barrier and base with water.

With reference to FIG. 9A, in embodiments the disclosed barrier 900 is fixed to an underlying base 902 that increases friction with the underlying ground 704 and provides additional horizontal support to the barrier 900, at least due to raised boundaries 904 that extends in front of and behind the barrier 900, and in some embodiments form a rim that surrounds the barrier 900, thereby forming a hollow within which the barrier 900 resides. In the embodiment of FIG. 9A, the base 902 is inflatable with water, and is in liquid communication with the barrier 900, such that the entire assembly of base 902 and modular barrier 900 can be simultaneously inflated with water by applying the water through a fill hose 906 into a fill port 304 that is located on an outer side of the base 902. The filled base 902 and barrier 900 are illustrated in FIG. 9B.

Figure 10:
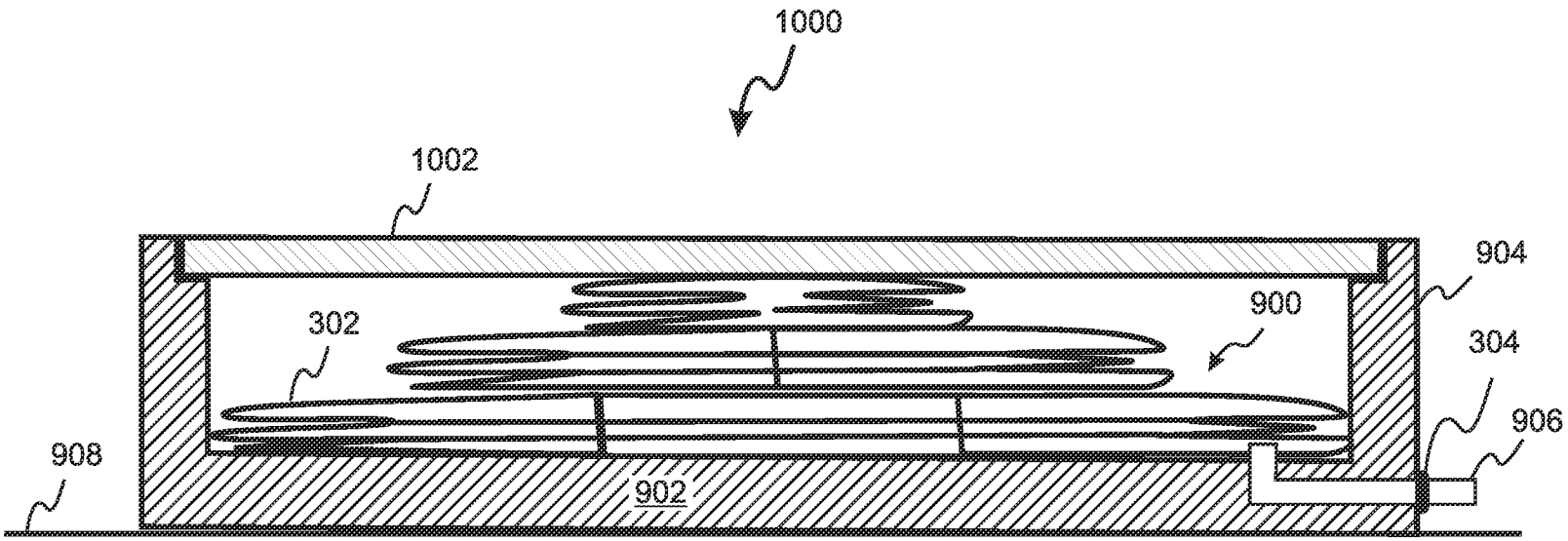
FIG. 10 is a side view of an embodiment that includes a barrier fixed to a substantially rigid base, where the barrier is not filled with water, and is covered by a lid, the base being installed above grade.

With reference to FIG. 10, in other embodiments the base 902 is substantially rigid. In the illustrated embodiment, a lid 1002 is provided that forms a chamber with the base 902 within which the deflated barrier 900 can be contained when not in use. Depending on the embodiment, the chamber can be open on its sides, or fully surrounded by the rim 904 of the base 902. This approach allows the entire assembly 1000 to be installed either above grade 908, as shown in FIG. 10, or below grade 908, as shown in FIG. 11.

Figure 11:
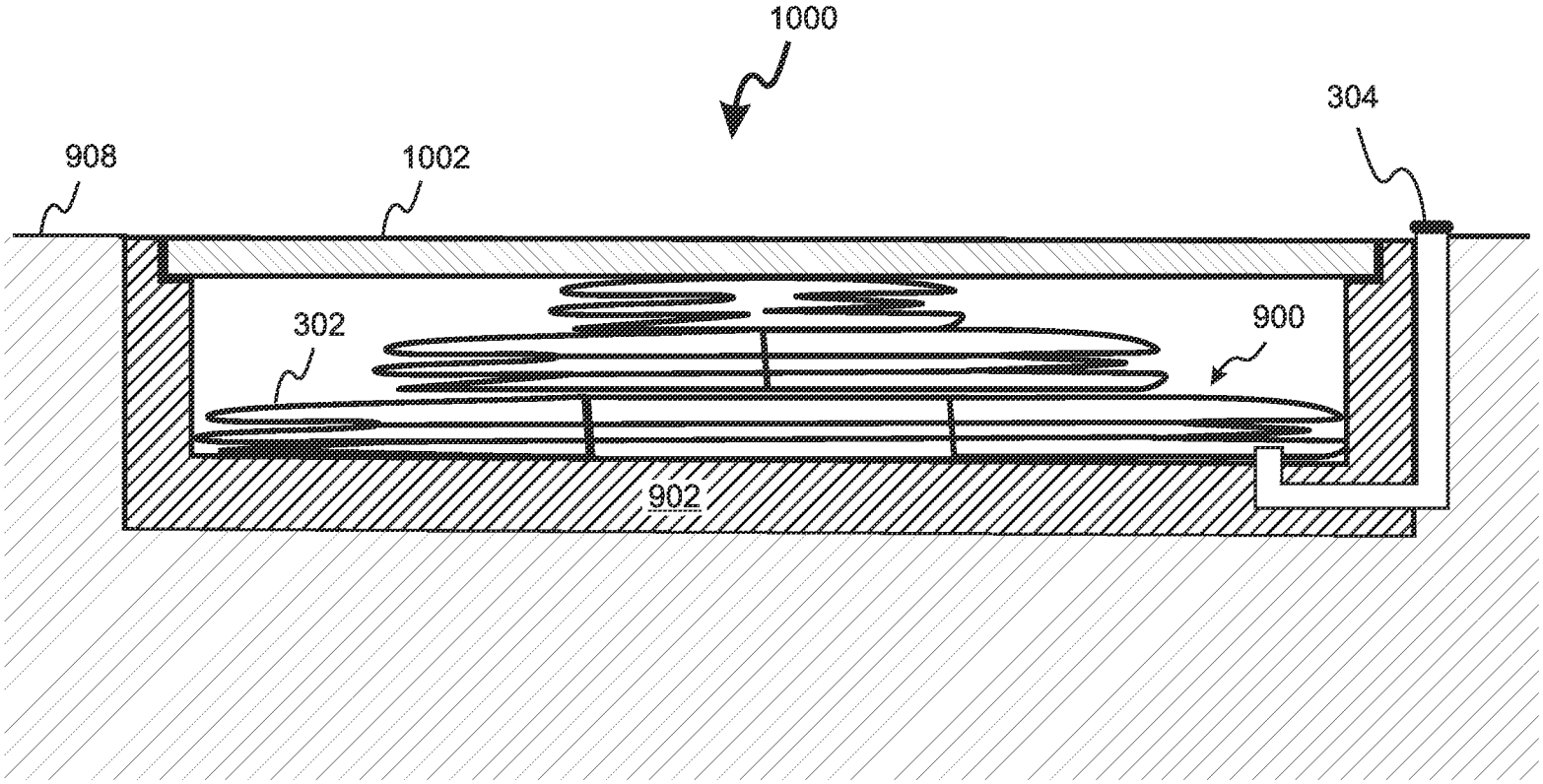
FIG. 11 is a side view of an embodiment similar to FIG. 10, where the base has been installed below grade.

FIG. 11 illustrates an embodiment similar to FIG. 10 in which the base 902 of the assembly 1000 has been installed below grade 908 at a site that is susceptible to flooding, such as a seashore or lake shore, with the top of the lid 1002 being at grade 908. When there is a present danger of a flood, it is only necessary to remove the lid 1002 and fill the barrier 900 with water. Being buried below grade 908 and fixed to the barrier 900, the base 902 provides firm resistance to horizontal displacement of the barrier 900 once it is filled with water.

Figure 12A:
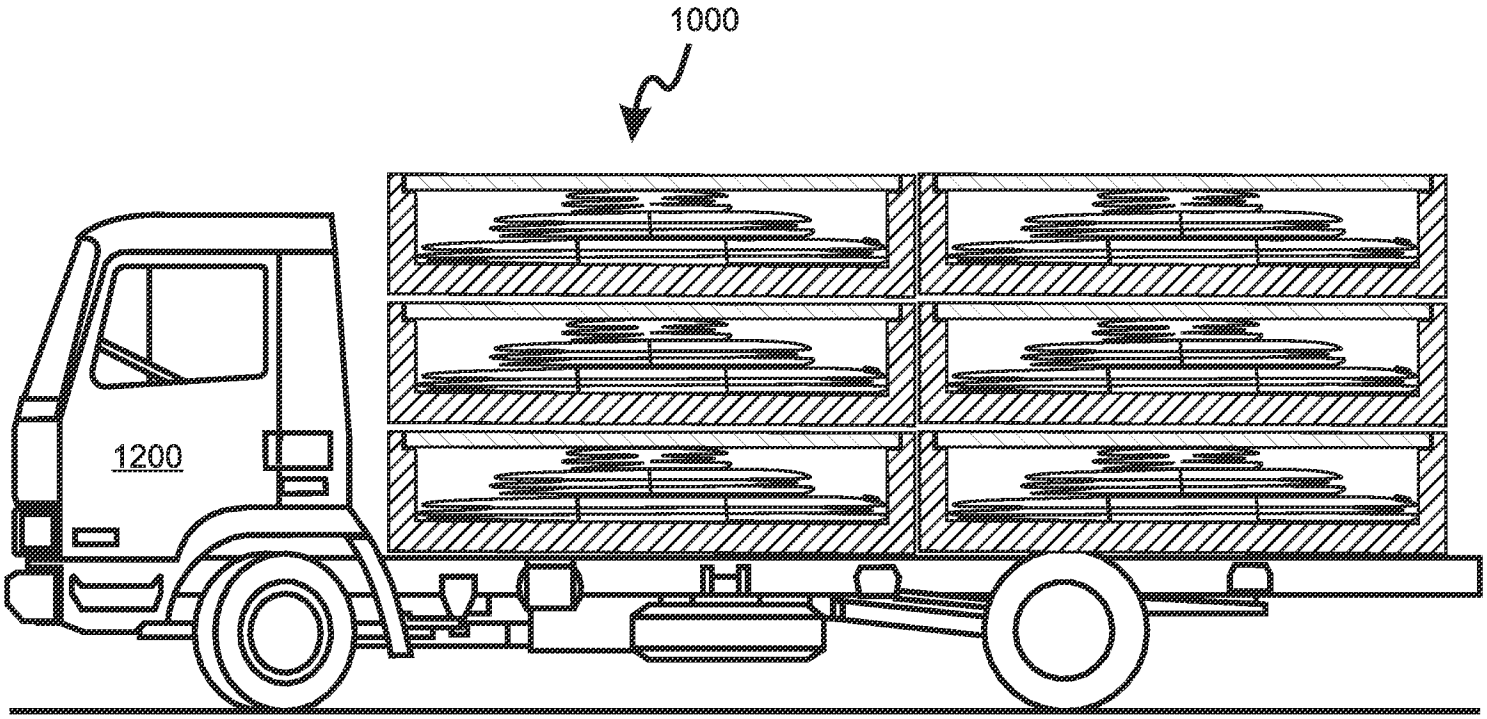
FIG. 12A illustrates transportation of stacked modules by a flatbed truck.

With reference to FIG. 12A, in other embodiments the entire assembly 1000 can be remotely stored, and then brought to the site when needed and deployed above grade 908. In the illustrated embodiment, the lid 1002 enables the barrier modules 900 with their bases 902 to be stacked on top of each other during storage and transportation, for example by a flatbed truck 1200.

Figure 12B:
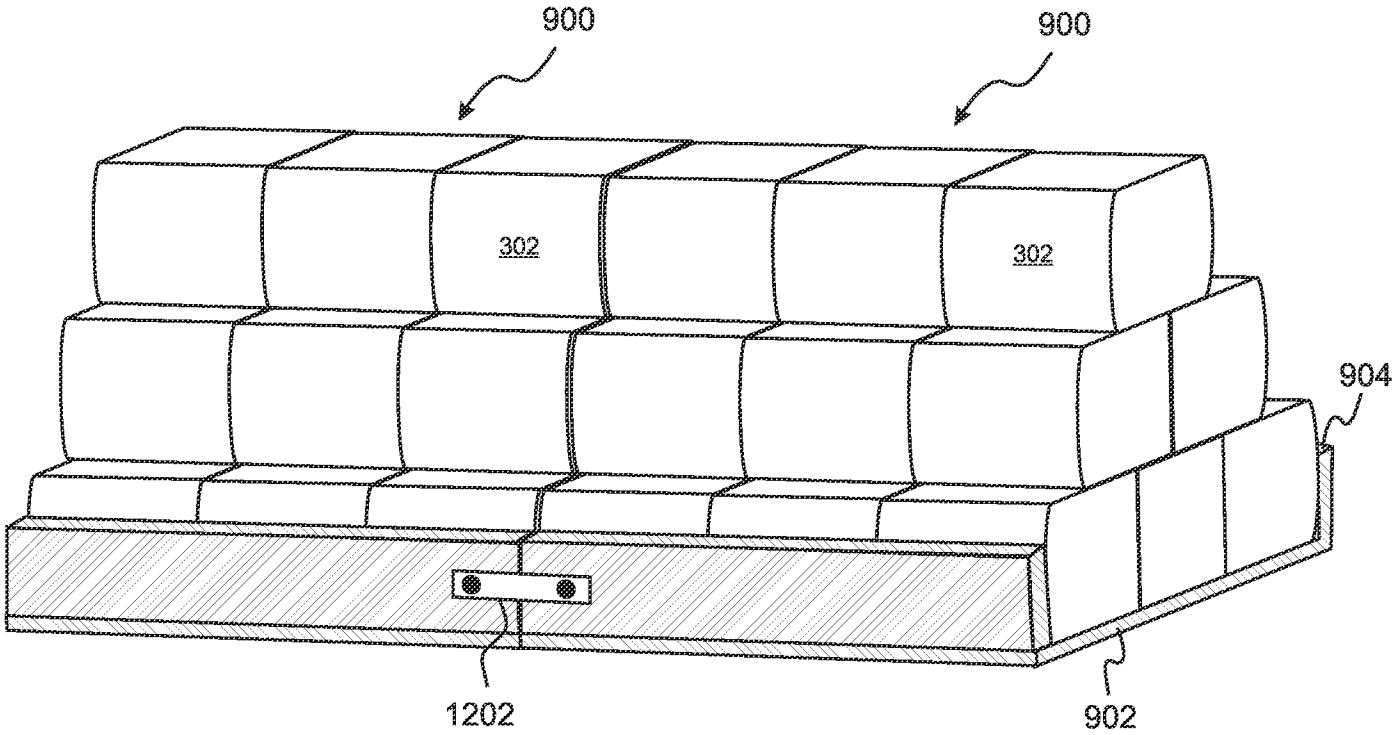
FIG. 12B is a perspective view of two adjacent modules that are similar to FIG. 9B, the bases of the modules being attached to each other by an attachment mechanism.

With reference to FIG. 12B, in embodiments the front and rear boundaries 904 of the bases 902 of a plurality of assemblies can be attached to each other by front and rear attachments 1202, thereby maintaining the respective barriers 900 in contact with each other.

Figure 13A:
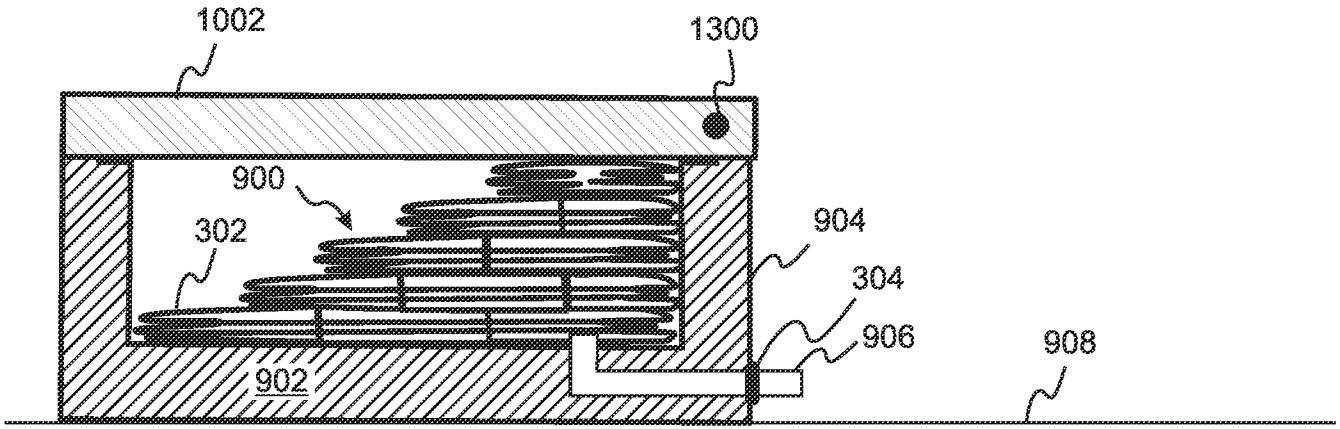
FIG. 13A is a side view of an embodiment that includes a substantially rigid base with hinged lid, shown with the lid closed.
Figure 13B:
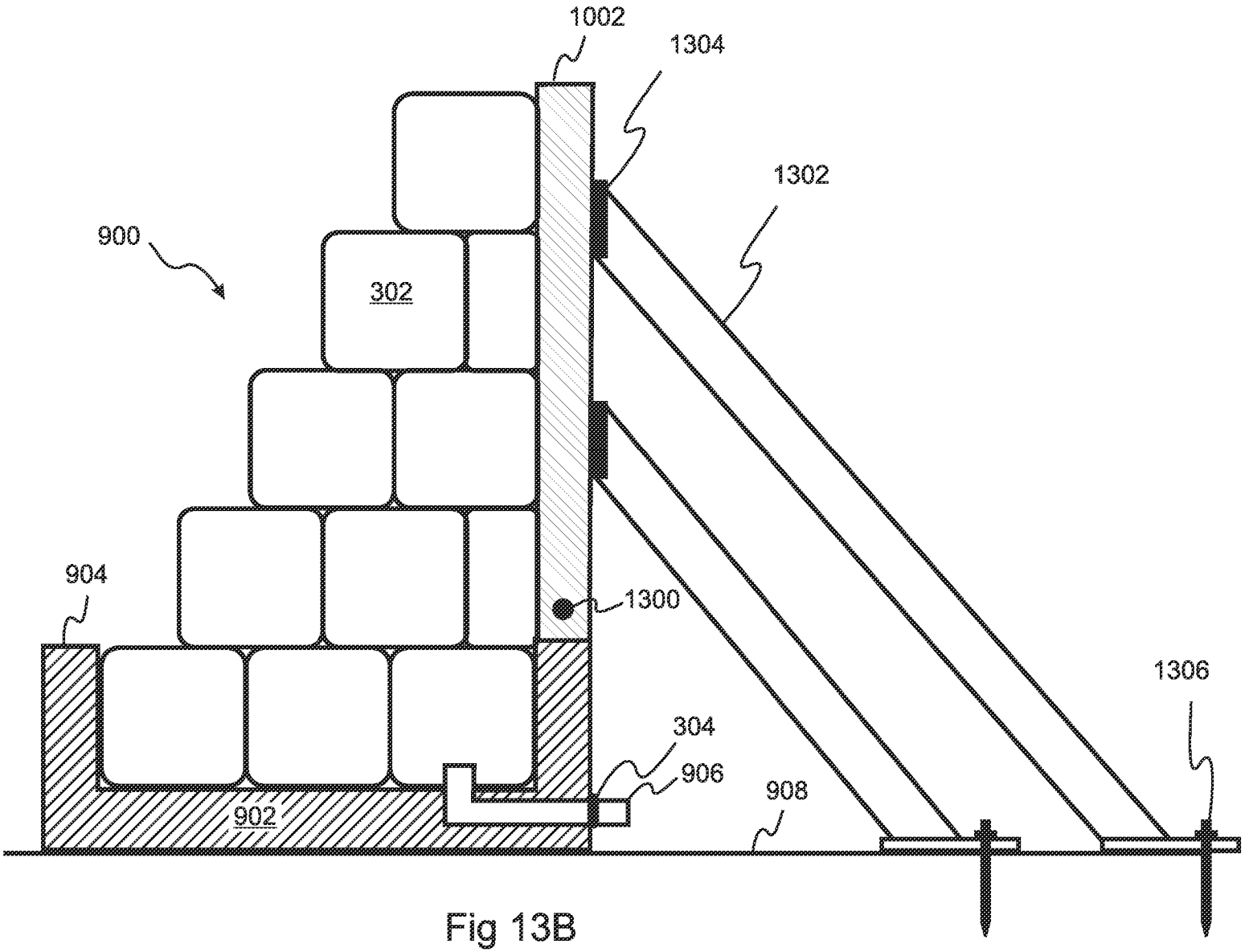
FIG. 13B is a side view of the embodiment of FIG. 13A, shown with the lid open and supported by a pair of braces and the barrier filled with water.

With reference to FIG. 13A, in some embodiments the lid 1002 is attached by a hinge 1300 to the base 902, such that it can be easily rotated out of the way to allow inflation of the barrier 902 without requiring removal and storage of the lid 1002. FIG. 13B illustrates the embodiment of FIG. 13A after the lid 1002 has been pivoted upward and the barrier 900 has been filled with water. In the illustrated embodiment, braces 1302 are provided that extend from a fitting 1304 provided on the opened lid 1002 to the ground 908 behind the base 902, for example at an angle of approximately 45 degrees, where the braces 1302 can be wedged in place, staked, or otherwise fixed to the ground. In the illustrated embodiment, the braces 1302 are fixed to the ground 908 by stakes 1306.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A water-inflatable barrier system comprising:

a first barrier module having:

first module flexible walls forming a first module shell configured to contain water within a first module interior of the first barrier module, said first module shell having a first module front, a first module rear, a substantially rectangular first module bottom, a first module length parallel to the first module front, a first module width perpendicular to the first module front, and a first module cross section that is wider at a first module bottom of the first barrier module than at a first module top of the first barrier module;

a plurality of substantially horizontal and substantially vertical first module partition walls dividing said first module interior into a plurality of adjacent, water-tight first module cells shaped as rectangular parallelepipeds, front and rear first module partition walls of each first module cell being substantially parallel to the first module front of the first module shell, said first module cells being arranged in a plurality of vertically stacked layers that are offset from each other such that none of the first module front and rear partition walls aligns with a first module front or rear partition wall in a vertically adjacent layer;

a first module water inlet in liquid communication with the first module interior; and a plurality of first module passages between the first module cells, said first module passages being configured to allow filling of all of the first module cells with water from the first module water inlet;

said first barrier module being fixed to a first base that underlies the first barrier module and is locatable on underlying terrain, said first barrier module being configured, when filled with water, to rise above front and rear boundaries of the first base that extend upward in front of and behind the first barrier module.

2. The barrier system of claim 1, wherein the front and rear boundaries of the first base are included in a raised perimeter that surrounds the first barrier module.

3. The barrier system of claim 1, wherein the first base is flexible, and is fillable with water.

4. The barrier system of claim 3, wherein the first base is in liquid communication with the first barrier module.

5. The barrier system of claim 1, wherein the first base is substantially rigid.

6. The barrier system of claim 5, further comprising a first lid configured to extend between the front and rear boundaries of the first base, thereby covering the first barrier module when it is not filled with water.

7. The barrier system of claim 6, wherein the first lid is attached to the rear boundary of the first base by a hinge, thereby enabling the first lid to be rotated into an open configuration that allows the first barrier module to expand above the front and rear boundaries of the first base as it is filled with water.

8. The barrier system of claim 7, further comprising a brace configured to extend from behind the first lid to said underlying terrain.

9. The barrier system of claim 8, wherein the brace includes an anchor configured to fix a distal end of the brace to the underlying terrain.

10. The barrier system of claim 9, wherein the anchor includes a spike configured for insertion into the underlying terrain.

11. The barrier system of claim 1, wherein the barrier system further comprises a second barrier module fixed to a second base, sides of said first and second barrier modules being configured for mutual contact.

12. The barrier system of claim 11, wherein the first and second bases are configured for mutual attachment that maintains the mutual contact between the sides of the first and second barrier modules.

13. A method of constructing a barrier assembly, the method comprising:

providing a water inflatable barrier system according to claim 1;

placing the barrier system at a desired location; and filling the first barrier module with water.

14. The method of claim 13, wherein the first base is flexible, fillable with water, and in liquid communication with the first barrier module, and wherein filling the first barrier module with water results in filling the first base with water.

15. The method of claim 13, wherein placing the barrier system at the desired location includes installing the first base below grade at the desired location.

16. The method of claim 13, wherein the barrier system further comprises a second barrier module fixed to a second base, and wherein placing the barrier system at the desired location further comprises placing the second base adjacent to the first base, thereby bringing the first and second barrier modules into mutual contact with each other.

17. The method of claim 16, wherein the second base is substantially rigid, wherein the barrier system further comprises a second lid configured to extend between front and rear boundaries of the second base, and wherein the method further includes placing the second lid onto the second base, the second barrier module not being filled with water, so that the second lid covers the second barrier module, and placing the first base on top of the second lid in a stacked configuration during at least one of storing the barrier system and transporting the barrier system to the desired location.

18. The method of claim 17, wherein the second lid is attached to the rear boundary of the second base by a hinge, and wherein the method further comprises:

rotating the first lid into an open configuration that allows the first barrier module to expand above the front and rear boundaries of the first base as it is filled with water; and fixing a proximal end of a brace to the first lid; and fixing a distal end of the brace to the underlying terrain.

19. The method of claim 18, wherein fixing the distal end of the brace to the underlying terrain includes inserting a stake into the underlying terrain.

20. The method of claim 13, further comprising inflating the first barrier module with air before placement of the barrier system at the desired location, and wherein filling the first barrier module with water includes removing said air from said first barrier module.

* * * * *